United States Patent [19]

Schollkopf et al.

[11] 4,245,583

[45] Jan. 20, 1981

[54] MECHANISM TO TRANSFER A VISCOUS COATING MEDIUM

[75] Inventors: Ernst Schollkopf; Walter Rimmele; Hans Skultety, all of Fribourg; Eduard Ortner, Villars-sur-Glane, all of Switzerland

[73] Assignee: Polytype AG, Fribourg, Switzerland

[21] Appl. No.: 969,789

[22] Filed: Dec. 15, 1978

[30] Foreign Application Priority Data

Dec. 19, 1977 [SE] Sweden ..... 7714432
Jul. 31, 1978 [SE] Sweden ..... 7808278

[51] Int. Cl.[3] ..... B05C 1/08

[52] U.S. Cl. ..... 118/259; 101/350; 118/249; 118/250; 427/428

[58] Field of Search ..... 118/249, 250, 259, 261; 101/350; 427/428

[56] References Cited

U.S. PATENT DOCUMENTS

| | | | |
|---|---|---|---|
| 2,344,427 | 3/1944 | Staude | 118/212 X |
| 2,382,929 | 8/1945 | Williams | 118/212 |
| 2,787,244 | 4/1957 | Hickin | 118/259 |
| 2,911,942 | 11/1959 | Gross | 118/259 X |
| 3,194,210 | 7/1965 | Harris | 118/261 X |
| 3,294,060 | 12/1966 | McIntyre et al. | 118/261 |
| 3,542,578 | 11/1970 | Lang | 427/428 X |
| 3,659,553 | 5/1972 | Tobias | 118/261 |
| 3,762,365 | 10/1973 | Herzog | 118/261 X |
| 4,022,154 | 5/1977 | Christensen | 118/261 |
| 4,046,924 | 9/1977 | Tanguy | 427/428 X |
| 4,167,916 | 9/1979 | Pierce | 118/212 |

*Primary Examiner*—Shrive P. Beck

[57] ABSTRACT

A viscous coating such as ink or material for surfacing a medium is transferred under pressure from a pressure chamber within a wetting container through a regulating opening and impinges on the surface of a transfer roller in such manner that the flow from the regulating opening is counter to the direction of rotation of the applicator roller. The required quantity of viscous coating medium on the applicator roller is transferred directly onto either a medium conveyor, a printing form or an inking roller.

9 Claims, 4 Drawing Figures

MECHANISM TO TRANSFER A VISCOUS COATING MEDIUM

The invention relates to apparatus and a method of utilizing the apparatus for transferring a viscous coating medium from a wetting container onto a medium conveyor such as is utilized in coating and printing machines. One wall of the wetting container is formed by a roller and an adjustable doctor blade.

BACKGROUND OF THE INVENTION

Various coating and printing procedures are known wherein the viscous coating medium is transferred from a container onto a roller, in which the roller is partly submerged in the viscous coating medium and also forms one wall of the container.

In order to regulate the amount of viscous coating medium, it is customary to utilize an adjustable doctor blade system against the roller surface. When using a smooth surface roller, the required film thickness is adjusted by the distance between the doctor blade and the roller surface, resulting in a regulated transfer of the coating medium thickness. But, when using an etched roller, the quantity of coating medium transferred is determined by the size and quantity of screened etchings on the roller surface. The doctor blade is brought into scraping contact with the roller surface to preserve the uniformity of coating medium as determined by the recesses formed by the etching on the roller.

The transfer of a viscous coating medium onto a medium conveyor is never complete whether a smooth or an etched roller is used. Experience has shown that a certain percentage of the viscous coating medium remains in the fine etching cells, and that after each new coating, a small build-up of the viscous coating medium results. This build-up of coating medium must be regularly cleaned out, which is a very time consuming operation.

When the coating medium is an ink used in printing operations, the transfer of the coating medium has been performed by means of inking rollers, oscillating rollers and transfer rollers and, then, finally onto a printing form or plate. The more modern viscous coating media for direct or indirect letterset and planographic printing processes are manufactured with such fine distribution and transfer properties that the use of extra distributing rollers can be eliminated, thus simplifying the inking units considerably.

SUMMARY OF THE INVENTION

It is an object of this invention to provide a mechanism for and a procedure for impinging viscous coating medium onto the roller, and for the transfer thereof onto a medium conveyor, printing form or inking roller.

In accordance with the present invention, the viscous coating medium is transferred under pressure, utilizing known means, from a pressure chamber through an adjustable opening onto a roller. The flow of the coating on to the roller is in the region of an adjustable doctor blade and in a direction counter to that of the rotation of the roller. This results in applying the new coating material to the roller just prior to the transfer of the coating material directly onto a medium conveyor, printing form or inking roller.

The foregoing and other objects and features of the present invention will become apparent from the following description and accompanying drawings.

BRIEF DESCRIPTION OF THE DRAWINGS

FIG. 3 is an elevation of the apparatus of the present invention as applied to a printing machine used to print the surfaces of tubes, tins, cups, lids, or the like.

DESCRIPTION OF THE PREFERRED EMBODIMENTS

Figure 1:
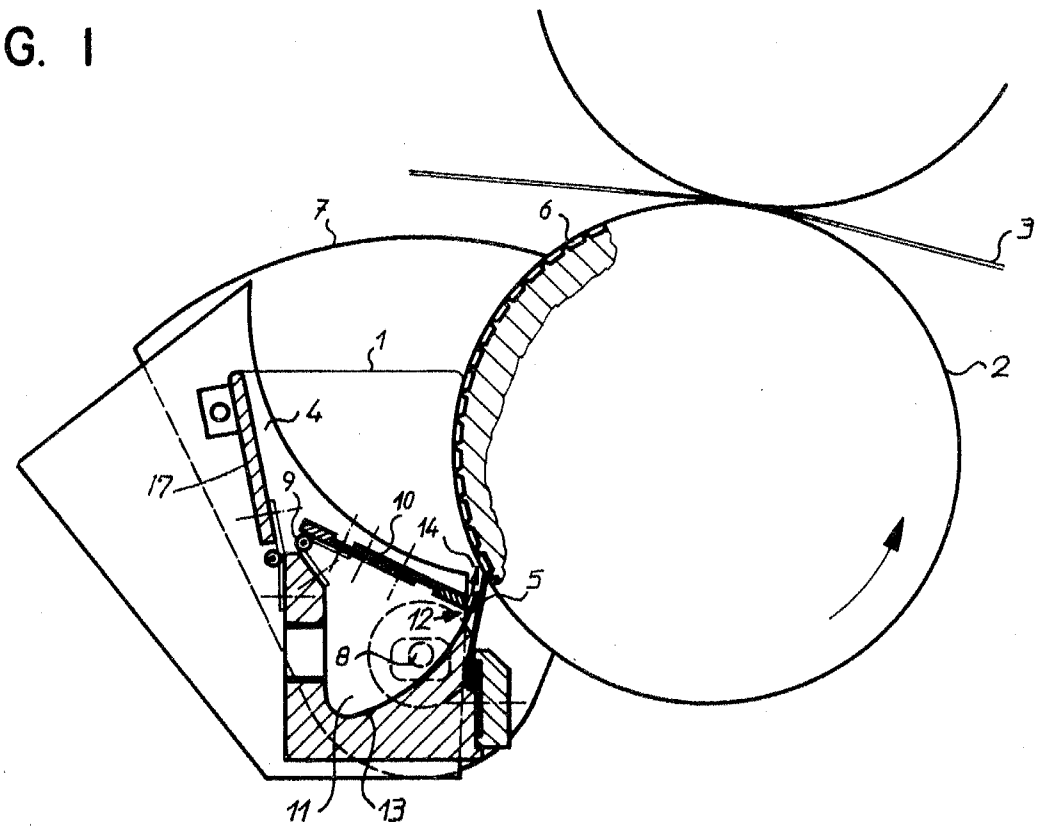
FIG. 1 is a sectional view of the apparatus of the present invention utilizing an etched roller and wetting container positioned to one side of the roller so that a single partition separates the pressure chamber and wetting container in a coating machine.

Referring to FIG. 1, viscous coating medium 1 in the container 4 is transferred directly by an etched roller 2 onto a medium conveyor 3. The roller 2 is rotating counterclockwise in FIG. 1. The surface of the roller 2 has a large plurality of etched cells 6 defined in it. The wetting container 4 has a doctor blade 5 mounted by known means on the bottom drainward side of the container. The edge of the doctor blade 5 is directed upstream toward the direction of rotation of roller 2 and is in scraping contact with the surface of roller 2. The amount of medium transferred is limited by the size of the etched cells 6 on the roller surface.

The angle of incidence of the doctor blade 5 on the roller 2 is adjustable. In order to make this adjustment, the wetting container 4 unit is pivoted about axis 8 and between two fixed side walls 7. The doctor blade is pivotally and laterally adjustable by known means. A dual-part partition wall 10 is hingedly mounted within the wetting container 4 about an axis 9 thus forming a pressure chamber 11 between lower wall 13 and partition wall 10 into which the viscous coating medium 1 is pumped under pressure by known means.

The pressure chamber 11 is adjustably connected to the wetting container 4 through an adjustable opening 12. The opening 12 is variable and adjustable both in its size and in its distance from the roller 2. The distance adjustment is obtained by altering either the distance between the partition wall 10 and the roller 2 or by pivotally adjusting the partition wall 10 about the axis 9, thereby varying the angle of attack or impingement of the viscous coating medium 1 onto roller 2. The size of opening 12 is adjusted by known means either by pivoting partition wall 10 or altering the dual-part partition 10 distance to roller 2.

The viscous coating medium 1 flows under pressure through the adjustable opening 12 in the direction of arrow 14, counter to the rotation of roller 2, thereby creating a turbulent washing effect in the etched cells 6 on the roller 2 surface. This turbulence prevents and eliminates the build-up of old coating medium within the fine etched cells 6 and enables a fresh layer of viscous coating medium 1 to be deposited in the fine etched cells 6. The excess viscous coating medium 1 flows back over the wetting container partition wall 17 into the reservoir before being recycled under pressure by known means.

Figure 2:
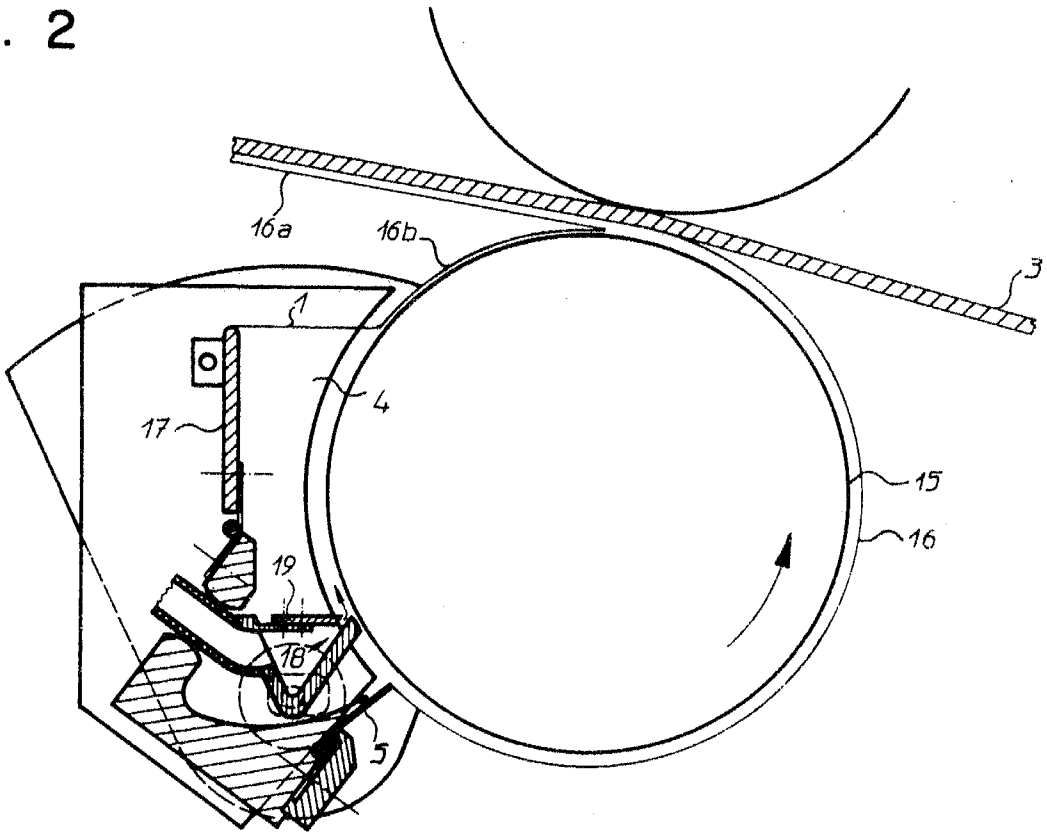
FIG. 2 is a sectional view of a second embodiment of the apparatus, corresponding to FIG. 1, but utilizing a smooth roller surface and a tubular pressure chamber positioned within the wetting chamber.

In the form of the invention shown in FIG. 2, the viscous coating medium 1 is directly transferred onto medium conveyor 3 by means of a smooth surfaced roller 15. The enlarged view of the medium conveyor 3 and of the viscous coating medium film 16 on the roller 15, illustrates the transfer process. Doctor blade 5 regulates the thickness of film 16. Part 16*a* of coating medium film 16 is transferred onto the medium conveyor 3 and the remaining thin layer portion 16*b* of film 16 returns on the roller 15 surface into the wetting container 4 from where the cycle is repeated.

In the FIG. 2 structure, and medium transfer operation, the doctor blade 5 extends almost radially to the roller 15 and the wetting container 4 is pivotally moved toward roller 15. Partition wall 17 is also pivotally adjustable and is kept close to a vertical orientation to maintain a large wetting container zone.

FIG. 2 further shows a further variation of the present invention by utilizing an adjustable tubular pressure chamber 19 that is placed within the wetting container 4. This replaces the dual-part partition 10 but nevertheless serves the same purpose, and it has an adjustable regulating opening 18.

The position of the complete wetting container 4 in relation to the rollers 2, 15 circumference has no effect on the effectiveness of the operation.

Figure 3:
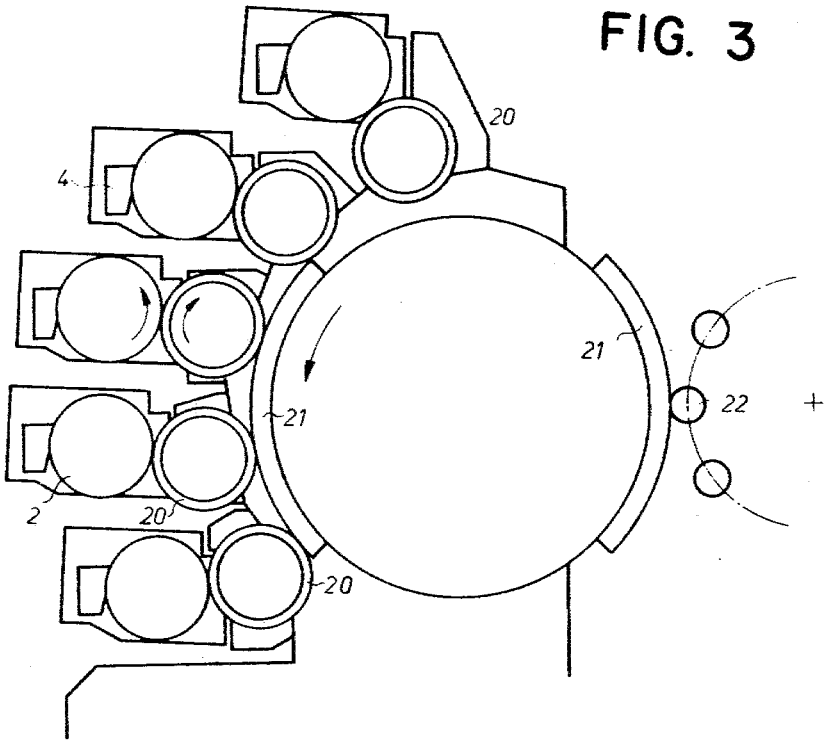

FIG. 3 illustrates the application of the present invention to a printing unit for printing tubes, tins, cups, lids and the like whereby the viscous coating medium is transferred from the schematically illustrated wetting containers 4 onto etched rollers 2 and directly onto printing forms 20 and by known means onto rubber blankets 21 and finally onto the medium conveyor 22.

Figure 4:
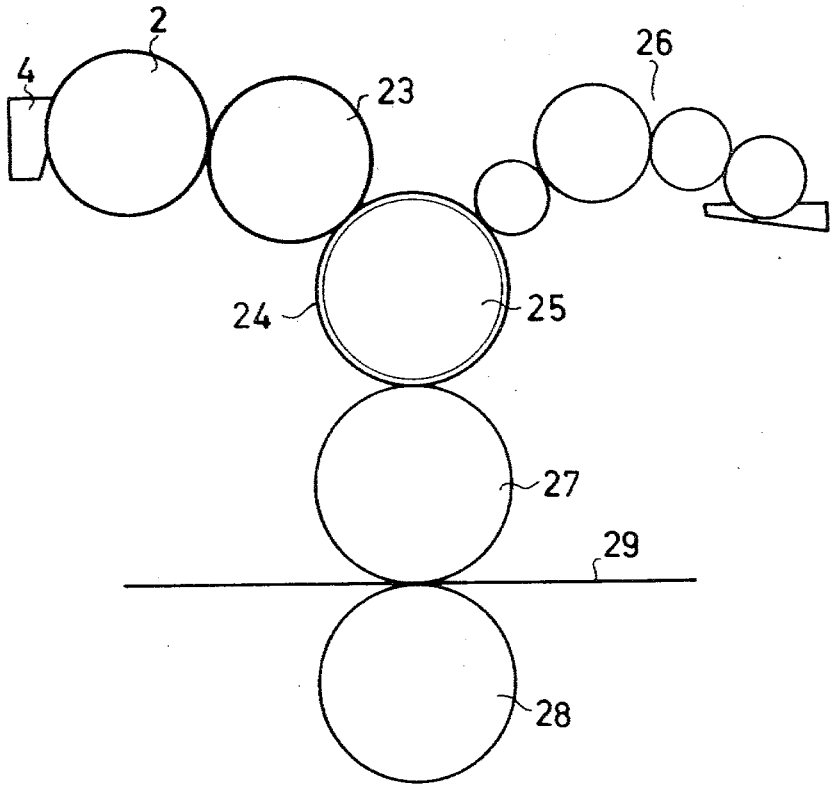
FIG. 4 is a diagrammatic elevation of an offset printing unit for printing web or sheet medium conveyors.

FIG. 4 illustrates the utilization of the present invention in an offset printing unit, whereby the viscous coating medium is transferred directly from roller 2 onto the inking roller 23 and then onto the printing plate 24 mounted on the plate cylinder 25. It is then transferred by known means onto a blanket cylinder 27 and finally onto the conveyor 29, either web or sheet fed. The complete offset unit includes damping unit 26 and support roller 28.

In the foregoing, the present invention has been described in connection with illustrative embodiments thereof. It is preferred that the scope of this invention be determined, not by the specific disclosures herein set forth, but only by the appended claims.

What is claimed is:

1. Apparatus for transferring a viscous coating material to a medium conveyor, printing form, inking roller, or the like, said apparatus comprising:

a wetting container for viscous coating material; said wetting container having a plurality of walls;

a rotating transfer roll and a doctor blade for said rotating transfer roll; said doctor blade being near to said transfer roll; said transfer roll and said doctor blade together forming one of said plurality of walls of said wetting container;

a pressure chamber for containing viscous coating material therein; a regulatable opening from said pressure chamber located near to said doctor blade and upstream in the path of rotation of said transfer roll from said doctor blade;

transfer means for transferring viscous coating material through said regulatable opening to said transfer roll adjacent said doctor blade; said opening being oriented so that the direction of transfer of viscous coating material through said regulatable opening is counter to the direction of rotation of said transfer roll upstream of the contact thereof with the medium conveyor, printing form, inking roller, or the like; said opening being so shaped, placed and angled and said transfer means being operative so that the force and angle of attack of viscous coating material from said pressure chamber onto said transfer roll removes excess coating material and built-up coating material from said transfer roll.

2. The apparatus of claim 1 wherein, said wetting chamber is so placed that any excess deposit of said viscous coating material on said transfer roll from said regulatable opening returns into said wetting chamber.

3. The apparatus of claim 2 wherein said transfer roll is directly in contact with the medium conveyor, printing form, inking roller, or the like.

4. The apparatus of claim 1 wherein a plurality of rollers are provided between said transfer roll and the web.

5. The apparatus of claim 1 wherein said regulatable opening extends across the length of said transfer roll.

6. The apparatus of claim 1 wherein said regulatable opening is adjustable with respect to its size and its distance from said transfer roll.

7. The apparatus of claim 6 wherein said wetting container is pivotally mounted and radially adjustable with respect to said transfer roll; means in said pressure chamber maintain a positive chamber pressure.

8. The apparatus of either of claims 6 or 7 wherein said pressure chamber is tubular in shape and is mounted in said wetting container; said pressure chamber having an adjustable said regulatable opening.

9. The apparatus of claim 7 wherein said doctor blade is carried by said wetting chamber and the radial adjustment of said wetting chamber results in adjustment of the angle of said doctor blade.

* * * * *